United States Patent [19]

Doser et al.

[11] 3,970,484

[45] July 20, 1976

[54] SINTERING METHODS FOR COBALT-RARE EARTH ALLOYS

[75] Inventors: Manfred Doser, Edmore; Frederick G. Jones, Alma, both of Mich.

[73] Assignee: Hitachi Magnetics Corporation, Edmore, Mich.

[22] Filed: Jan. 20, 1975

[21] Appl. No.: 542,190

[52] U.S. Cl. ..... 148/103; 148/31.57; 148/105

[51] Int. Cl.$^2$ ..... H01F 1/02

[58] Field of Search ..... 148/101, 103, 105, 108, 148/31.55, 104, 31.87; 75/200, 211, 213

[56] References Cited

UNITED STATES PATENTS

| | | | |
|---|---|---|---|
| 3,607,462 | 9/1971 | Laing | 148/104 |
| 3,681,151 | 8/1972 | Donkersloot et al. | 148/105 |
| 3,684,499 | 8/1972 | Hofer et al. | 75/211 |
| 3,701,695 | 10/1972 | Buschow et al. | 148/103 |
| 3,755,007 | 8/1973 | Benz et al. | 148/101 |

OTHER PUBLICATIONS

Cech, R; *Sintering . . . $Co_5$–Sm Magnets*, in *Jour. Appl. Phys.; 41*, Dec. 1970, pp. 5247–5249.

*Primary Examiner*—Walter R. Satterfield
*Attorney, Agent, or Firm*—Allard A. Braddock

[57] ABSTRACT

The invention covers the use of reactive hydrogen-containing atmospheres in the sintering and heat-aging of cobalt-rare earth intermetallic products.

11 Claims, No Drawings

SINTERING METHODS FOR COBALT-RARE EARTH ALLOYS

BACKGROUND OF THE INVENTION

Permanent magnets composed of cobalt and rare earth alloys have come into prominence in recent years because of the very high energy product of such magnets and because they can maintain a high and constant magnetic flux in the absence of an exciting magnetic field or electrical current to bring about such a field.

In order to prepare cobalt-rare earth magnets having the most desirable properties, it is necessary to exercise great care in the production of such magnets. Benz U.S. Pat. Nos. 3,655,463, 3,655,464, 3,695,945, and Benz and Martin U.S. Pat. No. 3,684,593 disclose and claim processes for making sintered cobalt-rare earth magnets.

Rare earth metals and alloys are very active chemically, particularly at elevated temperatures, and for this reason the four patents cited above stress the importance of inert atmospheres such as purified argon during production. It has long been known that rare earths will readily react with nitrogen and will also react with hydrogen to form hydrides. For this reason care has been taken to bar hydrogen from contact with the rare earth material during sintering and other high-temperature processing steps.

SUMMARY OF THE INVENTION

This invention is directed to the use of reactive hydrogen-containing atmospheres in preparing and processing cobalt-rare earth materials into high-performance permanent magnets.

DESCRIPTION OF PREFERRED EMBODIMENTS

The term "cobalt-rare earth" has come to mean a large class of materials. For example, magnets of highly desirable magnetic properties are produced if iron, manganese, aluminum, nickel or copper are present, individually or as mixtures, as alloy materials with cobalt. In addition the proportions of the cobalt and rare earth material may vary. For instance, good results have been achieved with such compounds as $Co_5R$, $Co_{17}R_2$, and mixtures of these with $Co_7R_2$, $Co_3R$ and $Co_2R$ (R represents a rare earth atom). The rare earth metals useful in the present invention are the fifteen elements of the lanthanide series having atomic numbers 57 to 71, inclusive. The element yttrium (atomic number 39) is commonly found with and included in this group of metals and is therefore considered a rare earth metal. Accordingly, as used herein, the term cobalt-rare earth may be considered as encompassing the variations described above.

In a typical procedure in accordance with this invention a cobalt-rare earth alloy is formed containing a major amount of $Co_5R$ intermetallic phase and a second CoR phase which is richer in rare earth metal content than the $Co_5R$ phase. This alloy, in particulate form, is pressed into compacts and sintered to a desired density in a hydrogen-containing atmosphere. The sintered product is comprised of a major amount of the $Co_5R$ intermetallic phase and up to about 35% by weight of the product of the other CoR intermetallic phases which are richer in rare earth metal content than the $Co_5R$ phase.

The procedure briefly described in the preceding paragraph can include the use of a surrounding magnetic field to align the particles during the pressing operation. Controlled cooling after completion of sintering will enhance the magnetic properties of the final product. A heat-aging treatment can further enhance the magnetic properties of the product.

The compressed compact, which is also referred to as a "green body", is sintered to the point of densification. As used herein, the point of densification is reached when the sintered body has a density of at least about 87% of theoretical. At this point the pores are substantially non-interconnecting, a condition which stabilizes the permanent magnet properties of the product because the interior of the sintered product or magnet is protected against exposure to the ambient atmosphere. One of the advantages of the use of hydrogen-containing atmospheres as in the present invention is that the final product is more dense than when a substantially inert atmosphere such as argon or helium is used. Densities of 97% of theoretical or more are customary when hydrogen-containing atmospheres are used.

The invention has been demonstrated using both liquid phase powders and solid phase powders. In preparing the liquid phase powder mixture, the procedure of Benz U.S. Pat. No. 3,655,464 was followed. A cobalt-samarium alloy composition containing a base material of about 34 weight percent samarium and an additive of 60 weight percent samarium was used. The 60 weight percent material was melted under argon and cast into ingots and the ingots were crushed. The crushed material was further reduced by fluid energy "jet" milling or attritor milling to a powder ranging in size from approximately 1 to 10 microns in diameter and generally to an average particle size of 4 microns. The solid phase powder mixture was prepared in accordance with Benz U.S. Pat. No. 3,655,463. In this case the composition contained a base of 34 weight percent samarium and an additive of 42 weight percent samarium.

In both the liquid and solid phase powders, the base alloys were prepared by reacting cobalt, samarium oxide and calcium hydride after the manner of Cech U.S. Pat. No. 3,748,193. In the solid phase powder, the additive was also prepared by the Cech process. This process is also used in preparing powders used in the process of Benz U.S. Pat. No. 3,695,945. Where the Cech process is used, the crushing step may be omitted as unnecessary. Milling alone is sufficient to produce particles of the desired small size.

The powders prepared in accordance with the above processes were compressed to form green bodies which were then sintered at temperatures in excess of 1100°C for 1 hour. They were then cooled to room temperature. When hydrogen was used as the sintering atmosphere, the atmosphere was switched to argon prior to the time cooling reached the 300°C level. This is necessitated by the fact that below 300°C the cobat-rare earth material will take on hydrogen which will desorb cobalt-rare at room temperature to create stresses which will lead to cracks in the material.

In all of examples 1 to 5 listed below in Table I, the material, which was binder-free, was given a post-sintering heat-aging treatment in an argon atmosphere at a temperature of 1100°C for 1 hour, cooled slowly to 900°C and quenched to room temperature.

TABLE I

| Example | Atmosphere | Sintering Temp. °C | Density | $B_r$ | $H_c$ | $H_{ci}$ | $BH_{max}$ | $\sigma_m$ |
|---|---|---|---|---|---|---|---|---|
| 1 | Argon | 1125 | 96.6 | 9000 | 8700 | 29,600 | 19.1 | 86.2 |
| 2 | Argon | 1125 | 96.4 | 8900 | 8650 | 30,000 | 18.9 | 85.4 |
| 3 | Hydrogen | 1125 | 98 | 9400 | 9250 | 16,900 | 21.2 | 88.8 |
| 4 | Argon | 1130 | 97.9 | 9160 | 8900 | 23,880 | 20.6 | 86.6 |
| 5 | Hydrogen | 1130 | 98.7 | 9475 | 9210 | 15,680 | 22.3 | 88.8 |

Examples 1 to 3 were composed of liquid phase powder and examples 4 and 5 of solid phase powder. The atmospheres of these examples were all either pure argon or pure hydrogen as indicated. The densities given are the percent of theoretical. The residual magnetic induction ($B_r$) is given in gausses. The normal coercive force ($H_c$) and the intrinsic coercive force ($H_{ci}$) are given in oersteds. The energy product ($BH_{max}$) is given in million gauss oersteds. $\sigma_m$, the magnetic moment, is the residual induction ($B_r$) divided by the quantity $4\pi$ times the specific gravity (fully dense material having a specific gravity of 8.6).

From the data of Table I it may be seen that sintering in a hydrogen atmosphere improves all of the properties of cobalt-rare earth material except intrinsic coercivity. However, the reduction in intrinsic coercivity properties does not prevent the use of hydrogen-sintered materials in many applications where the improvement in residual magnetic induction, coercivity and energy product confers advantages. Sintering in hydrogen rather than in an inert atmosphere also brings about an improvement in density. In general, sintering in hydrogen will produce the same density as sintering in argon at a temperature 40° lower than the temperature used for argon.

In Table II, examples 6 – 13 further illustrate the improvement brought about in the final product by the use of hydrogen as a sintering atmosphere.

TABLE II

| Example | Atmosphere | Sintering Temp. °C | Density | $B_r$ | $H_c$ | $H_{ci}$ | $\sigma_m$ | $BH_{max}$ |
|---|---|---|---|---|---|---|---|---|
| 6 | Argon | 1110 | 92.3 | 8050 | 7860 | — | 80.1 | 15.9 |
| 7 | Hydrogen | 1110 | 98.6 | 9365 | 9080 | — | 87.9 | 21.4 |
| 8 | Argon | 1120 | 97.4 | 8840 | 8620 | — | 84.0 | 19.2 |
| 9 | Hydrogen | 1120 | 98.8 | 9560 | 9130 | 16,220 | 89.6 | 21.6 |
| 10 | Argon | 1130 | 97.6 | 9275 | 8990 | 18,500 | 88.0 | 21.0 |
| 11 | Hydrogen | 1130 | 98.8 | 9610 | 8690 | 13,840 | 90.0 | 21.5 |
| 12 | Argon | 1140 | 97.8 | 9360 | 9000 | 16,700 | 88.6 | 21.1 |
| 13 | Hydrogen | 1140 | 98.8 | 9625 | 8440 | 12,500 | 90.2 | 21.6 |

In Examples 6 – 13 all of the cobalt-rare earth powder was solid phase reduction-diffusion (Cech process) material.

From Table II it may be seen that a sintering treatment in hydrogen at 1110°C produces a greater density than a sintering treatment in an argon atmosphere at 1140°C. Perhaps the greatest improvement brought about by the use of a hydrogen atmosphere is in the residual magnetic induction. This is a very important figure since the useful magnetic moment ($\sigma_m$) is directly proportional to the residual induction of the cobalt-rare earth material. At lower sintering temperatures the improvement brought about by hydrogen sintering is particularly marked.

The magnetic properties of cobalt-rare earth materials may be improved by post-sintering heat-aging treatments. A typical heat treatment cycle is to bring the material to a temperature of about 1100°C for 30 or more minutes, cooling to 900°C at a rate of about 2°C per minute, and quenching to a temperature below 500°C. Such a treatment is particularly effective in raising the figure for intrinsic coercivity. The reheat cycle may be performed in a hydrogen atmosphere or in an inert atmosphere such as that provided by argon or helium. When the atmosphere is provided by hydrogen, it is desirable to change to a hydrogen-free atmosphere at some point in the cooling where the temperature of the cobalt-rare earth material is above 300°C. Whether a hydrogen or inert atmosphere is used, the effect of the reheat cycle is to increase intrinsic coercivity by at least 10% regardless of whether the original sintering was performed in hydrogen or in an inert atmosphere.

Samarium was the rare earth used in all of examples 1 – 13. However, this was largely because samarium is readily available in pure form and is representative of the class. Other rare earths give comparable results and mixtures of rare earths (mischmetal-MM) may be used. particularly useful mixtures are samarium with cerium-mischmetal, samarium-praseodymium, samarium-gadolinium and samarium-neodymium.

Examples 14 – 17 of Table III give the properties for magnets made with a powder consisting of $Co_5(Sm_{.89}MM_{.11})$.

TABLE III

| Example | Atmosphere | Sintering Temp. °C | Density | $B_r$ | $H_c$ | $H_{ci}$ | $BH_{max}$ |
|---|---|---|---|---|---|---|---|
| 14 | Argon | 1120 | 96.9 | 9350 | 8800 | 20,300 | 21.2 |
| 15 | Argon | 1130 | 96.3 | 9400 | 8700 | 18,300 | 21.2 |
| 16 | Hydrogen | 1115 | 97.6 | 9700 | 9200 | 28,300 | 22.3 |
| 17 | Hydrogen | 1115 | 97.6 | 9600 | 9400 | 28,600 | 22.6 |

In examples 14 – 17 the material was binder-free. The base material was made by the Cech process. A liquid phase additive was used. Sintering time was 1 hour. A heat treatment at 1100°C was followed by cooling to 880°C for 5 hours and then oil quenching.

Table III clearly shows that high-temperature hydrogen treatments provide improved products where the rare earth includes material other than samarium. It is worthy of note that in this case the intrinsic coercivity was greater for material sintered in a hydrogen atmosphere than for material sintered in an argon atmosphere.

While the hydrogen atmospheres of Tables I, II and III were pure hydrogen, it is to be noted that mixtures of hydrogen and inert gases such as argon or helium may also be used. A hydrogen content as low as 1 percent by volume will result in an enhancement of properties as illustrated in Tables I, II and III. However, as the hydrogen content is increased so is the enhancement and an all-hydrogen atmosphere is preferred in the practice of the invention. While atmospheric pressure is satisfactory, either subatmospheric or superatmospheric pressures may also be used.

While the invention has been described with reference to certain specific embodiments, it is obvious that there may be variations which properly fall within the scope of the invention. Accordingly, the invention should be limited in scope only as may be necessitated by the scope of the appended claims.

What we claim as new and desire to secure by Letters Patent of the United States:

1. A process for producing a high-density cobalt-rare earth intermetallic product having a high magnetic moment and having substantially stable permanent magnet properties which comprises providing an alloy of cobalt and rare earth metal in particulate form, said cobalt and rare earth metal being used in proportions substantially corresponding to those desired in a final sintered product, pressing said particulate alloy into a green body, sintering said green body in an atmosphere containing at least one percent hydrogen by volume to produce a closed-pore structure, and cooling said green body in an atmosphere which is changed from hydrogen-containing to inert at a temperature above about 300°C.

2. A process as claimed in claim 1 followed by a heat-aging treatment in an atmosphere containing at least one percent hydrogen by volume, the hydrogen-containing atmosphere being changed during cooling to an inert atmosphere before reaching about 300°C.

3. The process of claim 2 in which the heat treatment is at a temperature of about 1100°C for about ½ hour followed by cooling at a controlled rate to about 900°C followed by quenching to a temperature below 500°C.

4. The process of claim 1 in which the atmosphere during sintering is composed entirely of hydrogen.

5. The process of claim 2 in which the atmosphere during heat aging is composed entirely of hydrogen.

6. The process of claim 1 in which the rare earth is samarium.

7. The process of claim 1 in which the rare earth is a mixture of samarium and cerium-mischmetal.

8. The process of claim 1 in which the pressing of the green body takes place in an aligning magnetic field.

9. The process of claim 1 in which the rare earth is a mixture of samarium and praseodymium.

10. The process of claim 1 in which the rare earth is a mixture of samarium and gadolinium.

11. The process of claim 1 in which the rare earth is a mixture of samarium and neodymium.

* * * * *